US009487967B2

(12) United States Patent
Anson et al.

(10) Patent No.: US 9,487,967 B2
(45) Date of Patent: Nov. 8, 2016

(54) KIT FOR TEMPORARY WIRE BARRIERS

(71) Applicants: Andrew Philip Anson, Montreal (CA); Benjamin Buchanan Anson, Beaconsfield (CA)

(72) Inventors: Andrew Philip Anson, Montreal (CA); Benjamin Buchanan Anson, Beaconsfield (CA)

( * ) Notice: Subject to any disclaimer, the term of this patent is extended or adjusted under 35 U.S.C. 154(b) by 377 days.

(21) Appl. No.: 13/783,186

(22) Filed: Mar. 1, 2013

(65) Prior Publication Data

US 2014/0246638 A1 Sep. 4, 2014

Related U.S. Application Data

(60) Provisional application No. 61/605,530, filed on Mar. 1, 2012.

(51) Int. Cl.

| | |
|---|---|
| ***B21F 27/00*** | (2006.01) |
| ***E04H 17/02*** | (2006.01) |
| ***E04H 17/16*** | (2006.01) |
| ***E04H 17/10*** | (2006.01) |
| ***E01F 13/02*** | (2006.01) |

(52) U.S. Cl.

CPC ..... *E04H 17/161* (2013.01); *E01F 13/028* (2013.01); *E04H 17/10* (2013.01)

(58) Field of Classification Search

CPC ..... E01F 13/028; E04H 17/10; E04H 17/161
USPC ..... 256/35, 37, 40, 41, 42, 54, DIG. 3, 256/DIG. 5

See application file for complete search history.

(56) References Cited

U.S. PATENT DOCUMENTS

| | | | | | |
|---|---|---|---|---|---|
| 545,460 | A * | 9/1895 | Diller | E04H 17/10 | 256/37 |
| 1,048,451 | A * | 12/1912 | Goodrich | E04H 17/12 | 256/58 |
| 4,349,181 | A * | 9/1982 | Asher | E04H 17/08 | 256/22 |
| 4,763,879 | A * | 8/1988 | Wasicek | E04H 17/08 | 256/36 |
| 5,061,109 | A * | 10/1991 | Miller | E04H 17/08 | 403/35 |
| 5,139,235 | A * | 8/1992 | Kilmer | E02D 5/801 | 256/35 |
| 5,356,101 | A * | 10/1994 | Malloy | E04H 12/2215 | 248/156 |
| 5,593,142 | A * | 1/1997 | Gerhart | E04H 17/12 | 256/32 |
| 5,649,690 | A * | 7/1997 | Kilmer | E04H 12/2223 | 248/156 |
| 7,093,824 | B2 * | 8/2006 | Pulliam | A01K 3/00 | 256/35 |
| 2012/0298942 | A1 * | 11/2012 | Tyrrell | A01K 3/00 | 256/10 |
| 2013/0175487 | A1 * | 7/2013 | Dettor | A63B 61/00 | 256/24 |

* cited by examiner

*Primary Examiner* — Gregory Binda
*Assistant Examiner* — Nahid Amiri
(74) *Attorney, Agent, or Firm* — Equinox IP; Franz Bonsang

(57) ABSTRACT

A kit for a temporary barrier includes at least two vertical post members, a contiguous wire and a tensioning device. The at least two vertical post members define respective top and bottom ends thereof and are positioned on an underlying surface in a spaced apart relationship. The wire runs between the two vertical post members at least towards their respective top ends and at least towards their respective bottom ends thereby providing a top wire portion and a bottom wire portion extending between the two vertical post members. The two vertical post members have respective arcuate bodies along their respective length for arcuately receiving the wire. The tensioning device is mounted to one of the two vertical post members near one of the top or bottom ends thereof and provides tension to the wire. A barrier is provided by the previous kit. A method for building a temporary kit includes mounting vertical posts on an underlying surface in a spaced apart relationship and running a wire between them.

9 Claims, 17 Drawing Sheets

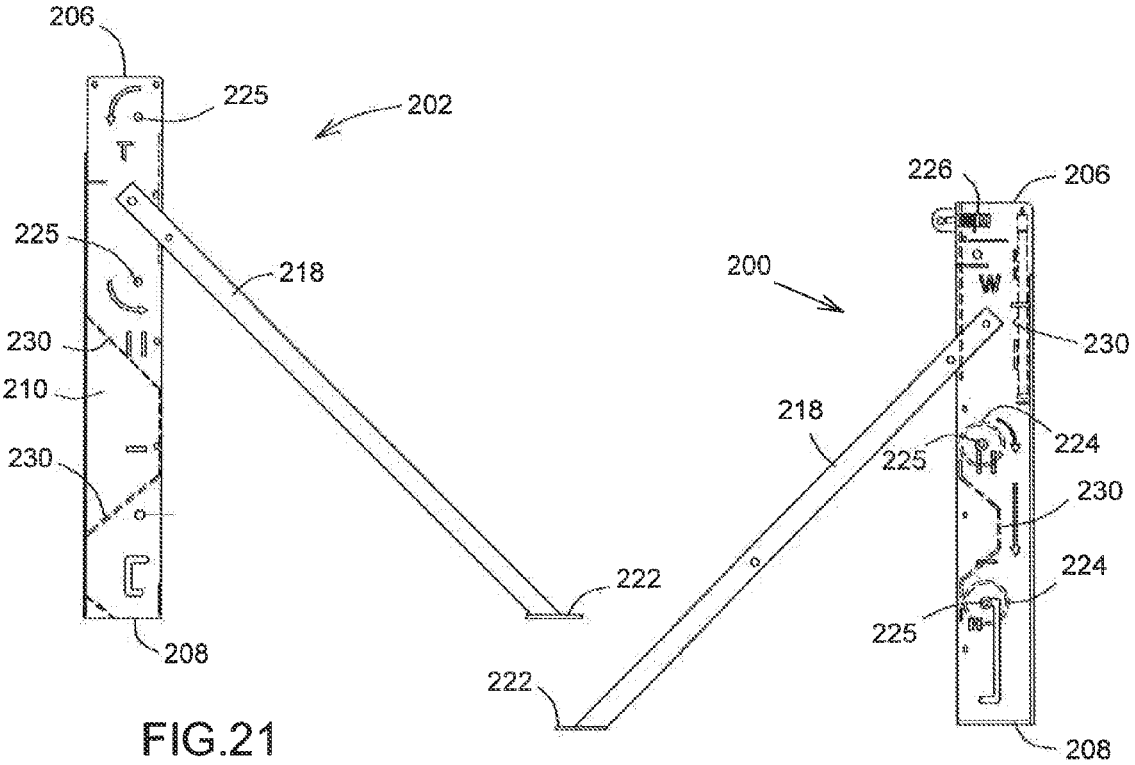
FIG.21
FIG.19
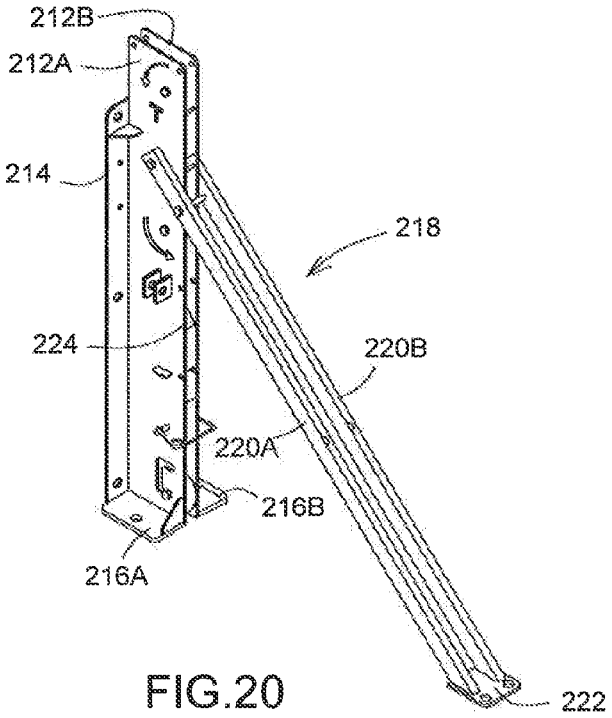
FIG.20

KIT FOR TEMPORARY WIRE BARRIERS

CROSS-REFERENCE TO RELATED APPLICATIONS

The present application claims priority on U.S. Provisional Patent Application Ser. No. 61/605,530 filed on Mar. 1, 2012 and incorporated herein by reference in its entirety.

TECHNICAL FIELD

The present disclosure relates to temporary barriers. More specifically, but not exclusively the present disclosure relates to a kit of temporary wire barriers.

BACKGROUND

Temporary barriers for the purpose of public safety or security, such as panels, fences, and the like are used when permanent structures are not needed. There are many uses for such barriers, including without limitation, enclosing areas under construction, restricting the public from industrial or public works sites, providing security during outdoor events or at emergency/disaster relief areas.

Drawbacks of current temporary barriers include the amount of time, labor and material that are required to set them up and take them down which increase costs and delay projects. Due to the fact that strong structures need to be used for safety reasons, these barriers usually include cumbersome components that are difficult to transport and manipulate. Moreover, once these barriers are set up, their components are not convenient for modifying the configuration of the barrier structure such as selectively opening and closing barrier portions or selectively lengthening and shortening the structure.

While cutting back on security is not an option, there is a need for temporary barrier systems that are easier and faster to set up, that use less material, that are more convenient to transport and that are adapted to be modified once erected.

OBJECTS

An object of the present disclosure is to provide a kit of a temporary barrier.

An object of the present disclosure is to provide a method for installing a temporary barrier.

An object of the present disclosure is to provide a temporary barrier.

SUMMARY

In accordance with an aspect of the present disclosure, there is provided a kit for a temporary barrier comprising: at least two vertical post members defining respective top and bottom ends thereof for being positioned on an underlying surface in a spaced apart relationship; a contiguous wire for running between the two vertical post members at least towards their respective top ends and at least towards their respective bottom ends thereby providing a top wire portion and a bottom wire portion extending between the two vertical post members; the two vertical post members comprising respective arcuate bodies along their respective length for arcuately receiving the wire; at least one tensioning device for being mounted to one of the two vertical post members near one of the top or bottom ends thereof for providing tension to the wire, wherein the wire mounted to the vertical post members provides a barrier.

In an embodiment, the kit further comprises a material for being mounted to the top and bottom wire portions and extending therebetween and at least towards each of the two vertical post members thereby forming the barrier. In an embodiment, the material comprises a pair of sheets for being folded together so as to sandwich the wire portions therebetween. In an embodiment, the free ends of the sheets are provided to be clipped together with at least one of the top or bottom wire portions.

In an embodiment, the wire is mounted on a reel for being fed between the vertical post members via the tensioning device. In an embodiment, the reel is provided to be mounted on one of the two spaced apart vertical post members and the wire comprises a free end secured to either one of the two vertical post members. In an embodiment, the top wire portion is positioned at a height at least near the top ends of the vertical post members. In an embodiment, the bottom wire portion is positioned at least near the level of the underlying surface.

In an embodiment, the tensioning device comprises a winch.

In an embodiment, the arcuate bodies are rollers rotatably mounted to the vertical post members for rotatably receiving the wire.

In an embodiment, at least one of the two vertical post members comprises at least one support leg for extending therefrom to the underlying surface.

In an embodiment, the kit further comprises a median wire portion extending between the two vertical post members and interposed between the top and bottom wire portions.

In an embodiment, the kit further comprises at least one additional vertical post member for being positioned between two vertical post members and comprising guide portions for respectively guiding the top and bottom wire portions. In an embodiment, at least one guide portion comprises a clamp for clamping the wire. In an embodiment, the kit further comprises a material for being mounted to the top and bottom wire portions and extending therebetween and at least towards each of the two vertical post members thereby forming the barrier, wherein the clamp clamps the wire with the material.

In an embodiment, at least one of the two post members comprises spaced apart lateral panels mounted to a back panel and having an open front face for receiving the wire therethrough and into the space defined by the lateral and back panels. In an embodiment, at least one arcuate body is interposed between the spaced apart lateral panels. In an embodiment, the at least one arcuate body comprises a roller for rollingly receiving the wire. In an embodiment, the kit further comprises a fastener mounted to the panels for fastening a free end of the wire within the space defined by the lateral and back panels. In an embodiment, the kit further comprises a leg for extending from the at least one vertical post member in the direction of the other vertical post member and being mounted to the underlying surface, the leg comprising a pair of spaced apart longitudinal members, each of the longitudinal members extending from a respective one of the spaced apart lateral panels and defining a space therebetween for allowing passage of the wire.

In an embodiment, the kit further comprises a corner post for being interposed between the two vertical post members and receiving the wire for forming a barrier corner. In an embodiment, the kit further comprises an additional vertical post member and an additional wire for running between one of the two vertical post members and the additional vertical post member. In an embodiment, at least one of the two vertical post members comprises corner vertical post member for forming a barrier corner with an additional vertical post member spaced apart therefrom, the kit further member further comprising an additional wire for running between the one of the two vertical post members and the additional vertical post member.

In accordance with an aspect of the present disclosure, there is provided a temporary barrier provided by the kits as previously described.

In accordance with an aspect of the present disclosure, there is provided a method of building a temporary kit comprising: mounting first and second vertical post member on an underlying surface in a spaced apart relationship, wherein the first and second vertical post members define respective top and bottom ends and comprise respective arcuate bodies along their respective lengths; running a contiguous wire between the first and second vertical post members about the arcuate bodies and at least towards their respective top ends and at least towards their respective bottom ends thereby providing a top wire portion and a bottom wire portion extending between the two vertical post members; providing tension to the wire.

In an embodiment, the method further comprises mounting a material to the wire extending between the two vertical post members. In an embodiment, the method further comprises mounting an additional vertical post member between two vertical post members and comprising guide portions for respectively guiding the top and bottom wire portions.

In accordance with an aspect of the present disclosure, there is provided a a kit for a temporary barrier comprising: at least two vertical post members defining respective top and bottom ends for being positioned on a surface in a spaced apart relationship; a wire for running between the two vertical post members at least towards their respective top ends and at least towards their respective bottom ends thereby providing a top wire portion and a bottom wire portion extending between the two vertical post members; at least one tensioning device for being mounted to one of the two vertical post members near one of the top and bottom ends thereof for providing tension to the wire; and a material for being mounted to the top and bottom wire portions and extending therebetween and at least towards each of the two vertical members thereby providing the barrier.

In an embodiment, the vertical post members comprise arcuate bodies for arcuately receiving the wire thereon. In an embodiment, the arcuate bodies comprise rollers.

In an embodiment, the kit further comprises a third vertical post member positioned between the two vertical post members and comprising guide portions for respectively guiding the top and bottom wire portions.

Other objects, advantages and features of the present disclosure will become more apparent upon reading of the following non-restrictive description of non-limiting illustrative embodiments thereof, given by way of example only with reference to the accompanying drawings.

BRIEF DESCRIPTION OF THE DRAWINGS

In the appended drawings, where like reference numerals denote like elements throughout and in where:

FIG. 19 is a lateral view of one of the winch or originating end post of the barrier of FIGS. 18A and 18B in accordance with non-restrictive illustrative embodiment of the present disclosure;

FIG. 20 is a perspective view of the end post of FIG. 19;

FIG. 21 is a lateral view of the terminal end post of the barrier of FIGS. 18A and 18B in accordance with non-restrictive illustrative embodiment of the present disclosure;

DETAILED DESCRIPTION

Generally stated and in accordance with a non-limiting embodiment of the present disclosure, there is provided a kit for a temporary barrier. The kit includes at least a pair of vertical posts that are mounted to a surface and spaced apart. A wire is mounted to the vertical members so as to extend therebetween. The wire is positioned near or at the top ends and near or at the bottom ends of the post members so as to define top and bottom spaced apart wire portions. A tensioner such as a winch provides sufficient tension to the wire. A material such as a mesh or netting is mounted to the wire and extends between its top and bottom portions as well as extending towards each vertical post member to thereby provide the barrier.

With reference to the appended Figures, non-restrictive illustrative embodiments will be herein described so as to further exemplify the disclosure only and by no means limit the scope thereof.

FIGS. 1, 6, 11, 12, 13 and 14 respectively show barriers B1, B2, B3, B4, B5 and B6 provided by the various kits of the disclosure as will be exemplified below.

Figure 1:
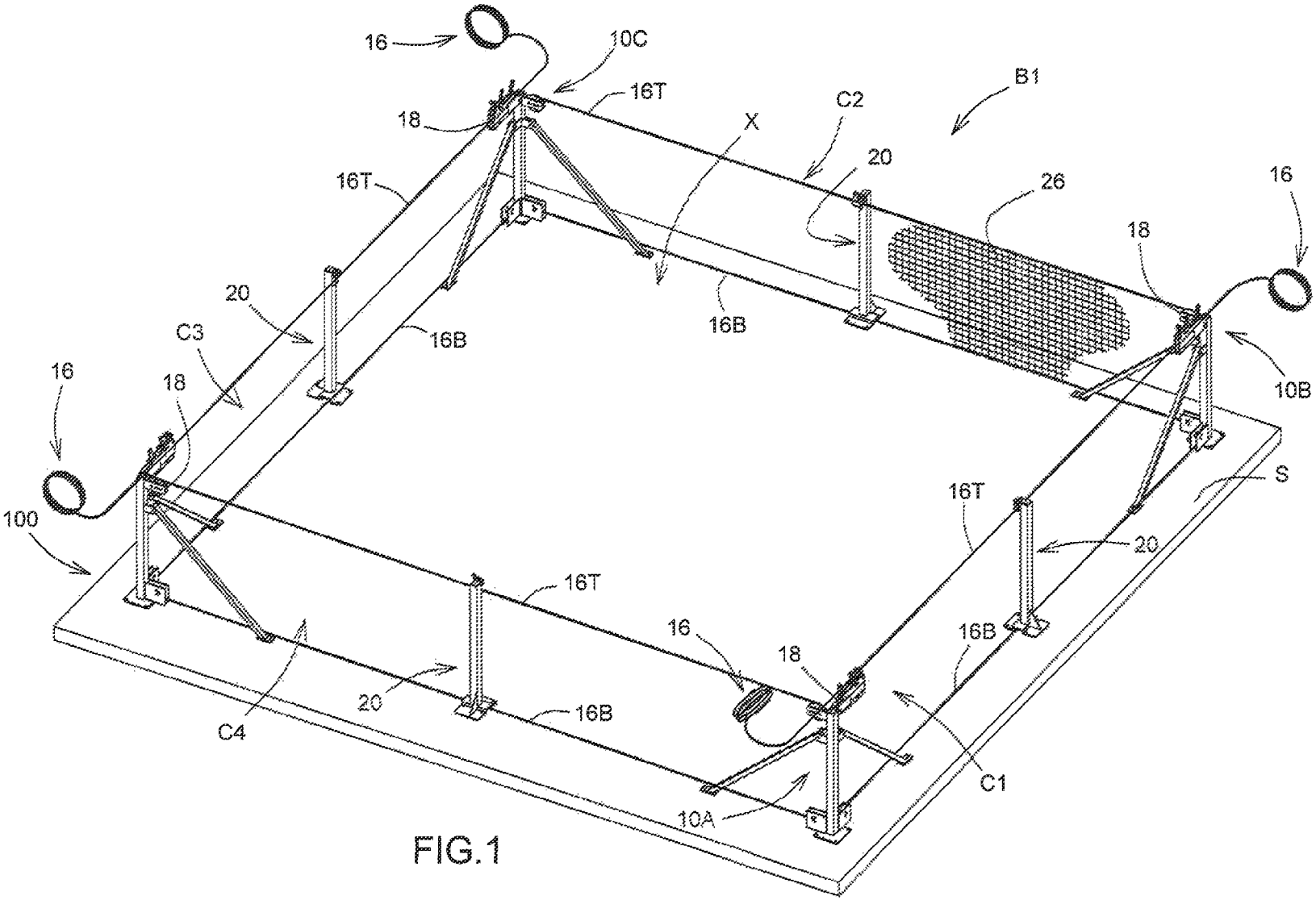
FIG. 1 is a perspective view of an enclosure barrier provided by the kit of the present disclosure in accordance with a non-restrictive illustrative embodiment thereof.

FIG. 1 shows barrier B1 providing an enclosure and mounted on a surface S for enclosing an area X. The barrier B1 comprises four corner vertical anchor posts 10A, 10B, 10C and 10D. As better shown in FIG. 2, each vertical post, generally denoted 10, defines respective top and bottom ends, 12 and 14 respectively. A wire 16 runs between each pair of adjacent anchor posts 10A and 10B, 10B and 10C, 10C and 10D, and 10D and 10A. The wire 16 is positioned near the top ends 12 and the bottom ends of 14 of each of the posts 10A 10B, 10C, and 10D thereby defining top and bottom wire portions 16T and 16B respectively. The wire 16 of each pair of adjacent posts is mounted to a tension device 18, such as a winch and conveniently arranged in a roll for providing tension to the wire 16 between adjacent vertical anchor posts. In this example, there are four winch devices 18, each mounted to a respective vertical anchor post 10A 10B, 10C, and 10D.

Figure 4:
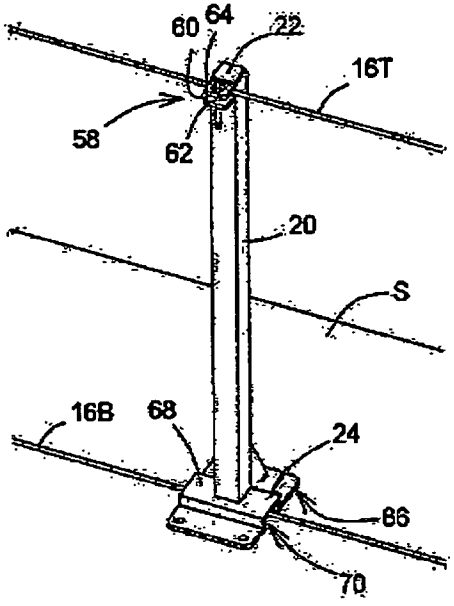
FIG. 4 is a perspective view of an inline guide post of the kit of the present disclosure in accordance with a non-restrictive illustrative embodiment thereof.

An inline post 20 is positioned between each pair of adjacent posts 10A and 10B, 10B and 10C, 10C and 10D, and 10D and 10A. As shown in FIG. 4, the inline post 20 defines top and bottom ends 22 and 24 respectively. The wire 12 runs along the width of the post 20 near its top and bottom ends, 22 and 24 respectively. A material 26, such as mesh or netting for example, is mounted to the top and bottom wire portions 16T and 16B and extends therebetween and towards the adjacent vertical posts thereby defining a barrier wall.

As such, the barrier B1 comprises four barrier wall sides C1, C2, C3 and C4. For example, barrier side C1 is defined by the post members 10A and 10B, and the tension in the wire 16 is adjusted by the winch 18 mounted on post 10A. As such, the wire 16 runs from the winch 18 towards post 10B and then downwardly along the length of post 10B to run back toward post 10A so as to be secured thereto. The wire can be secured or anchored on any portion of the originating post member 10A. The sides C2, C3 and C4 are similarly configured, with the wire in each case running from the winch 18 to the adjacent post, down the length of this post and back to the originating post to be secured thereon. The inline guide posts 20 between the pair of adjacent anchor posts 10 provides support for the wire top portion 16T so that it does not sag as well as support for the wire bottom portion 16B so that it does not curve upwardly thereby providing a convenient frame structure for the material 26.

Moreover, the winch 18 provides enough tension to the wire 16 so as to meet safety regulations.

Figure 2:
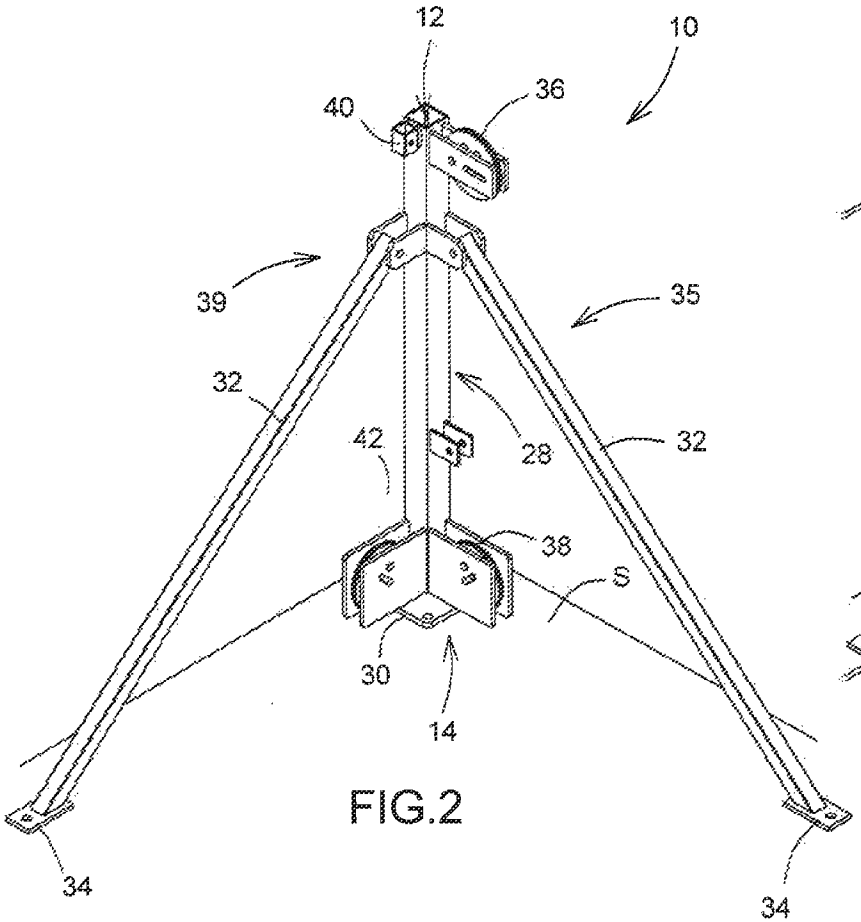
FIG. 2 is a perspective view of a corner vertical anchor post of the kit of the present disclosure in accordance with a non-restrictive illustrative embodiment thereof.

Turning to FIG. 2, there is shown a corner vertical anchor post 10 comprising a rectangular main post body 28 upstanding from a platform 30 designed to be secured to a surface. A pair of leg supports 32 extend from the main post body 28, at about a 90° angle from each other and include bottom feet 34 to be secured to the surface S thereby providing support and stability to the post 10 against wire tension. One lateral side 35 of the post 10 includes top and bottom arcuate bodies 36 and 38 respectively in the form of rollers. As such the lateral side 35 acts as a receiving post side for receiving the wire 16 from the originating post about top roller 36, the wire 16 then runs along the length of the main body 28 and about bottom roller 38 to run back towards the originating post as previously explained.

The post 10 also includes another later side 39 having a winch support 40 for receiving the winch 18, near the top end of the post 10 and a bottom roller 42. As such, the lateral side 39 of the post 10 acts as an originating post side with the wire 16 running from the winch to the receiving adjacent post, the bottom roller 42 receives the returning wire 16 from the receiving post and the wire is secured on the main body 28.

As shown in FIG. 1, the posts 10 provide for building corners and act as anchors for anchoring the wire 16 thereon as explained above.

In some cases and as will be understood by the skilled artisan, the wire 16 will not be returned back to the originating post along purely planar trajectory, but can be deviated about an corner to run along other post members before it returns back to the originating post member. For example, in FIG. 1, wire 16 runs from post 10A to 10B, yet instead of the wire returning from post 10B back to 10A, it can continue to run towards post 100 and then be returned back to post 10A for example. In this case, the post in the position of post 10B in FIG. 1 is a corner guide post and can be constructed as shown in FIG. 3.

Figure 3:
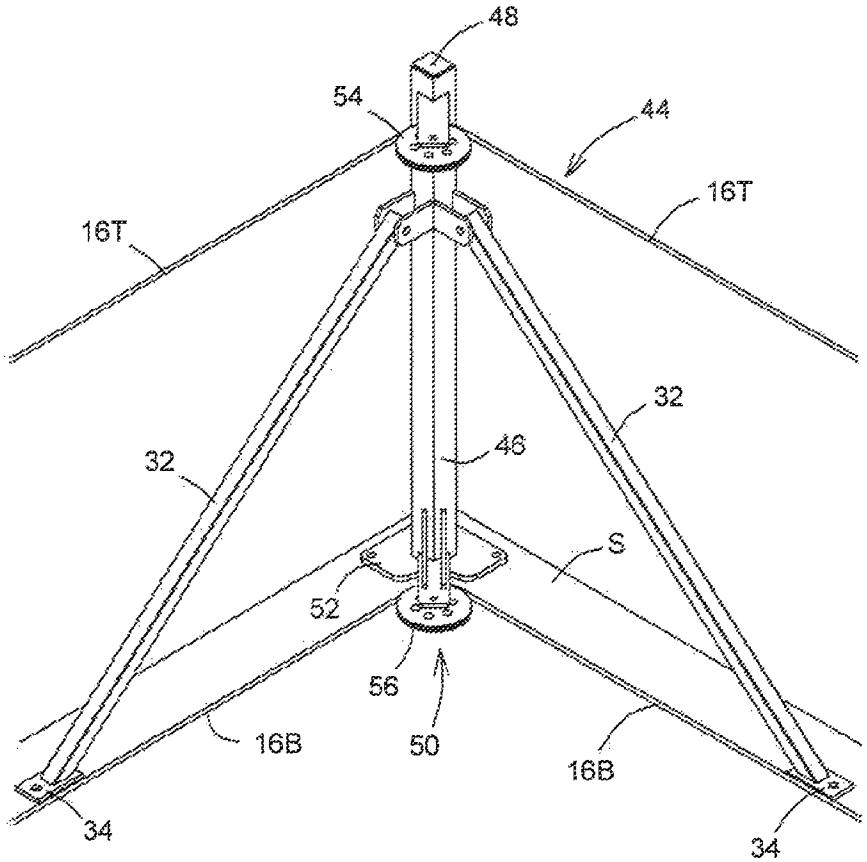
FIG. 3 is a perspective view of a corner vertical guide post of the kit of the present disclosure in accordance with a non-restrictive illustrative embodiment thereof.

FIG. 3 shows a corner guide post 44 having a main post body 46 defining top and bottom ends 48 and 50 respectively. The bottom end 50 includes a platform 52 for securing the post member 44 on a surface S. A pair of leg supports 32 extend from the main post body 46 and include bottom feet 34 to be secured to the surface S. Top and bottom arcuate bodies, in the form of circular supports, 54 and 56 are respectively mounted near the top and bottom ends 48 and 50. The wire top portion 16T runs along the arc provided by the top circular support 54 and the bottom wire portion 16B runs along the arc provided by the bottom circular support 56.

With respect to FIG. 4, the inline guide post 20 includes a bracket 58 near its top end having top and bottom spaced apart tongues 60 and 62, respectively with a set screw 64 journaled therethough to provide an enclosed backspace for the wire top portion 16T to pass but being delimited by the tongues 60, 62 and the set screw 64 which act as stoppers. A platform 66 is formed at the bottom end 24 of the post 20 and defines a flanged portion 68 which provides a delimited clearance to the bottom wire portion 16B within the opening 70 defined by the flanged portion 68. Therefore, the wire top and bottom portions 16T and 16B are maintained in position against tension force or sag.

Figure 5:
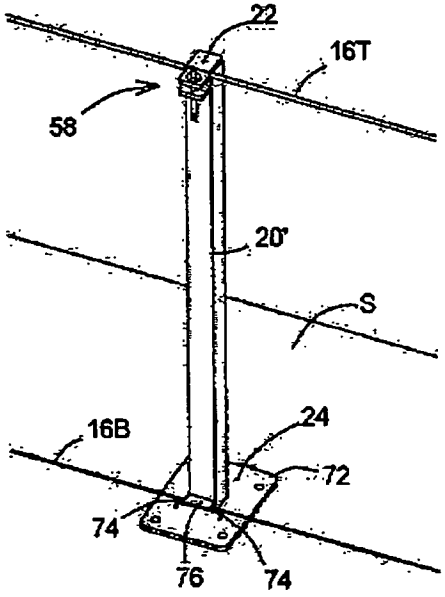
FIG. 5 is a perspective view of an inline guide post of the kit of the present disclosure in accordance with another non-restrictive illustrative embodiment thereof.

FIG. 5 illustrates another inline guide post 20' having a similar structure except for its bottom platform 72 which does not provide an underneath clearance. Instead a pair of pegs 74 upwardly protrude therefrom and a tongue 76 extends from the post 20 just above the platform 72, therefore, the wire 16 is blocked from lateral movement between the pegs 74 and the post 20' and from vertical movement between the tongue 76 and the platform 72 mounted to the surface S.

Figure 6:
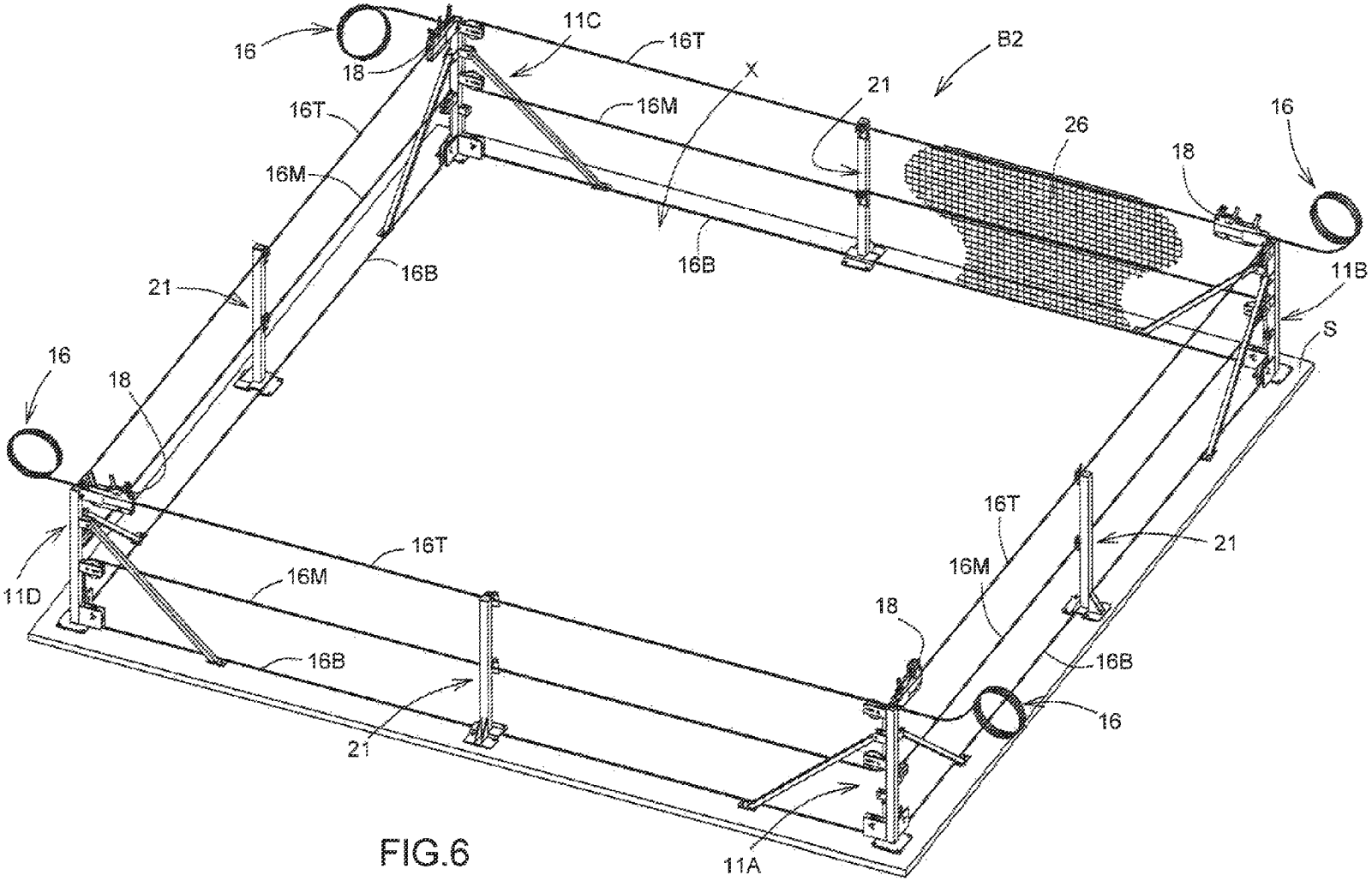
FIG. 6 is a perspective view of an enclosure barrier provided by the kit of the present disclosure in accordance with another non-restrictive illustrative embodiment thereof.

FIG. 6 shows an enclosure barrier B2 that is similar to enclosure barrier B1 with the exception that there are three wire portions running between adjacent posts. More specifically, in addition to the top and bottom wire portion 16T and 16B, there is also an intermediate wire portion 16M interposed therebetween. The foregoing is provided by the structure of corner vertical anchor posts 11A, 11B, 11C and 11D.

Figure 11:
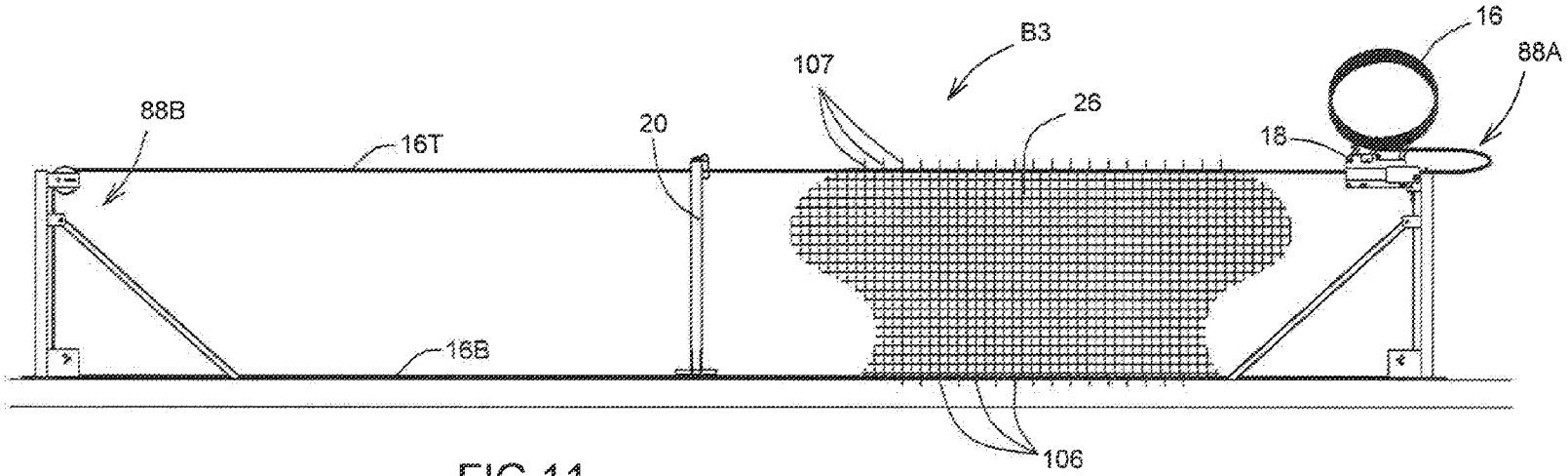
FIG. 11 front elevation view of a barrier wall of the kit of the present disclosure in accordance with a non-restrictive illustrative embodiment thereof.

Turning to FIG. 11, there is shown a corner vertical anchor post generally denoted 11 similarly constructed to post 10. As such, and for concision purposes only the differences of post 11 with post 10 will be discussed. The main post body 28 includes on its receiving side or lateral side 35' a third arcuate body 78, in the form of a roller, interposed between rollers 36 and 38 about a median portion along the main body 28 height. The lateral side 35' also includes a bracket 80 for securing the end of the wire 16 to the post 10. The main body also includes an originating side or lateral side 39' having an additional arcuate body 82, in the form of a roller, interposed between the winch support 40 and the bottom roller 42.

Figure 7:
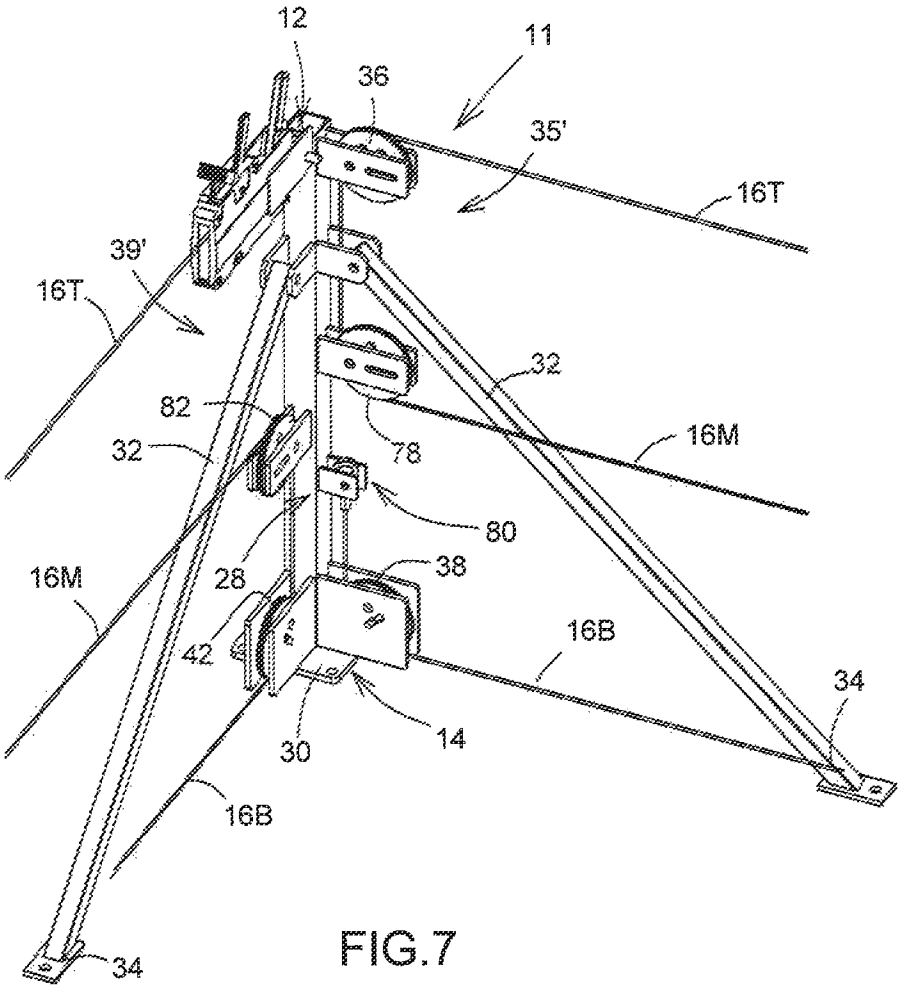
FIG. 7 is a perspective view of a corner vertical anchor post of the kit of the present disclosure in accordance with another non-restrictive illustrative embodiment thereof.

Returning back to FIG. 6 and with reference to FIG. 7, there is shown an adjacent pair of posts 11D and 11A, the originating side or lateral side 39' of post 11D interfaces with the receiving side or lateral side 35' of post 110. Accordingly, the wire runs from the winch 18 on post 110 towards post 11A and about top roller 36, thereby defining a top wire portion 16T. The wire 16 then runs downwardly along the length of post 11A and about intermediate roller 78 and back towards post 11D and about its intermediate roller 82 thereby defining an intermediate wire portion 16M. The wire 16 then runs downwardly along the length of post 11D and about the bottom roller 42 and towards post 11A to engage bottom roller 38 thereby defining the wire bottom portion 16B. The wire 16 then runs upwardly along the length of post 11A to be secured at bracket 80.

As shown in FIG. 6, the kit of the enclosure barrier B2 also includes inline guide posts 21 interposed between the pairs of adjacent posts 11A and 11B, 11B and 11C, 11C and 11D and 11D and 11A.

Figure 9:
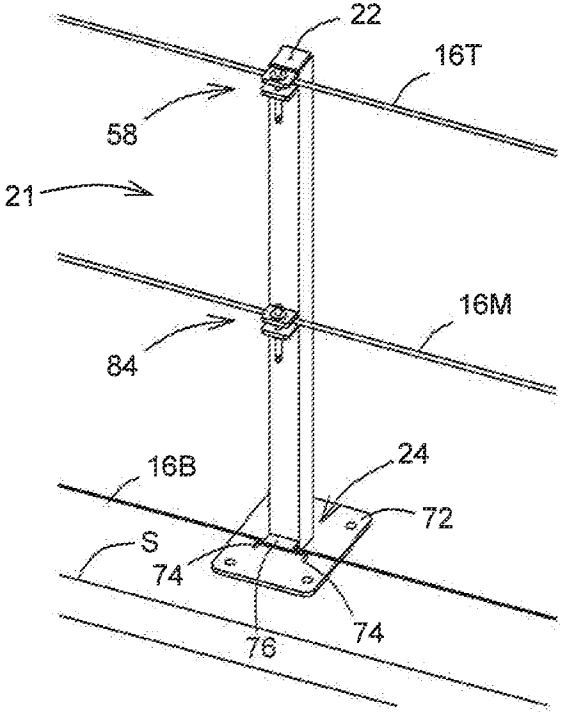
FIG. 9 is a perspective view of an inline guide post of the kit of the present disclosure in accordance with a further non-restrictive illustrative embodiment thereof.

FIG. 9 shows the inline guide post 21 which is similarly constructed to inline guide post 20' and as such, only its differences will be discussed for concision purposes only. Inline guide post 20 includes an intermediate bracket 84 similarly constructed to top bracket 58 for maintaining the intermediate wire portion 16M.

Figure 8:
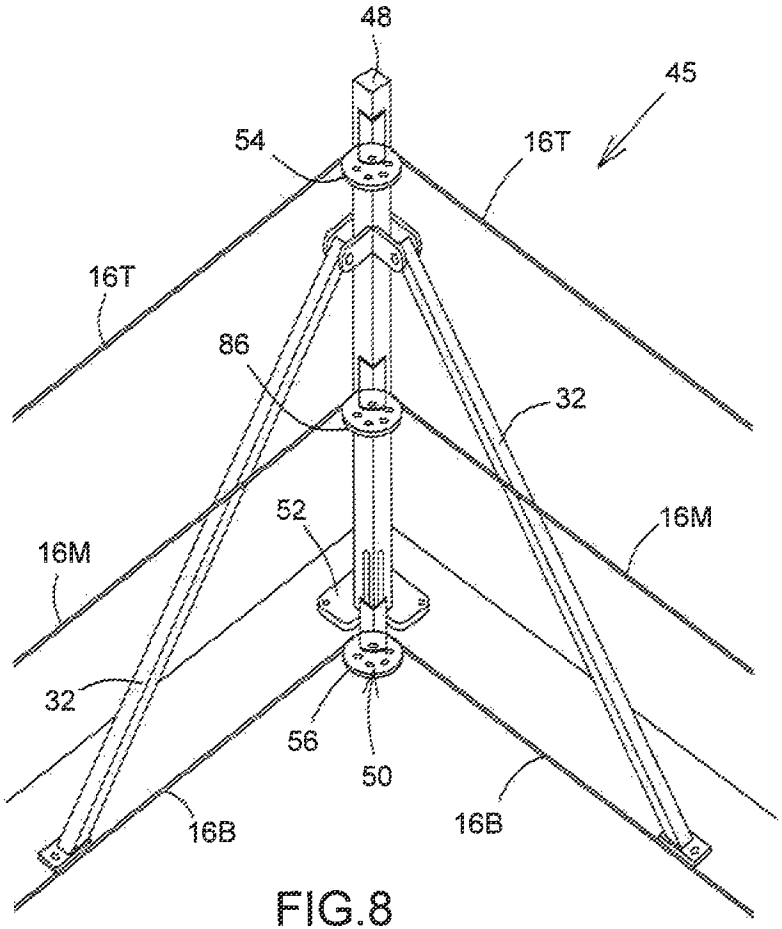
FIG. 8 is a perspective view of a corner vertical guide post of the kit of the present disclosure in accordance with another non-restrictive illustrative embodiment thereof.

FIG. 8 shows a corner guide post 45 similarly constructed to corner guide post 44, and as such, only its differences will be discussed for concision purposes only. The guide post includes an intermediate circular guide 86 interposed between the top and bottom guides 54 and 56 for receiving the intermediate wire portion 16M.

Barriers B1 and B2 described above were enclosure barriers. Of course, these enclosure barriers can have any of the lateral sides C1, C2, C3 or C4 open. Moreover, the corner guide posts 44 and 45 need not provide closed triangular enclosures but they can also provide open corner barrier structures.

Figure 12:
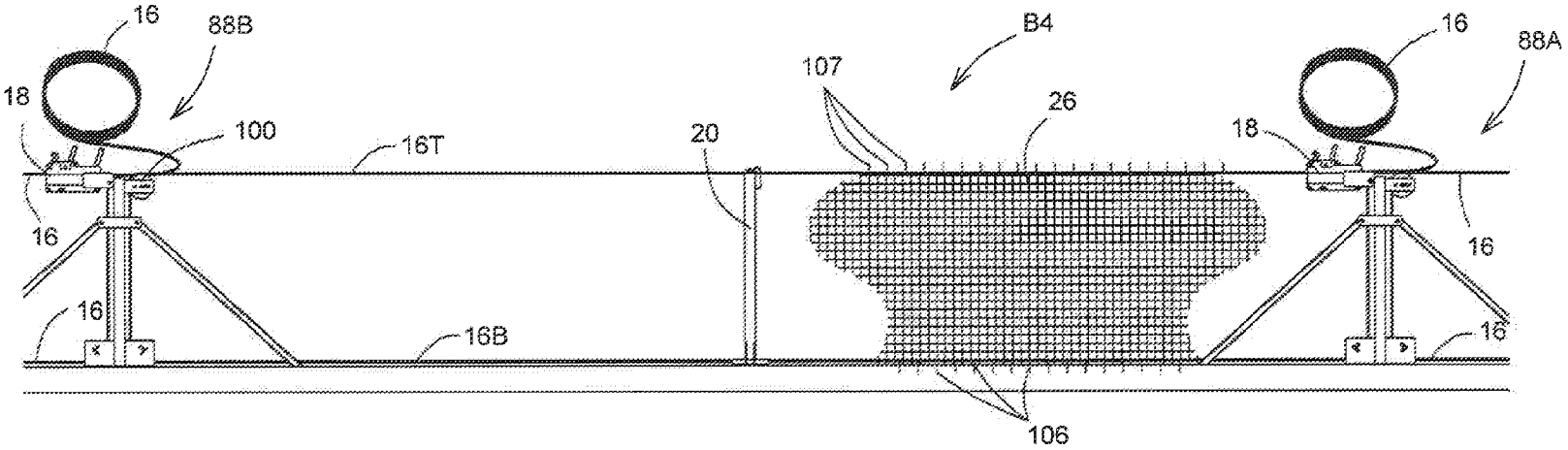
FIG. 12 front elevation view of a continuous barrier wall of the kit of the present disclosure in accordance with a non-restrictive illustrative embodiment thereof.
Figure 13:
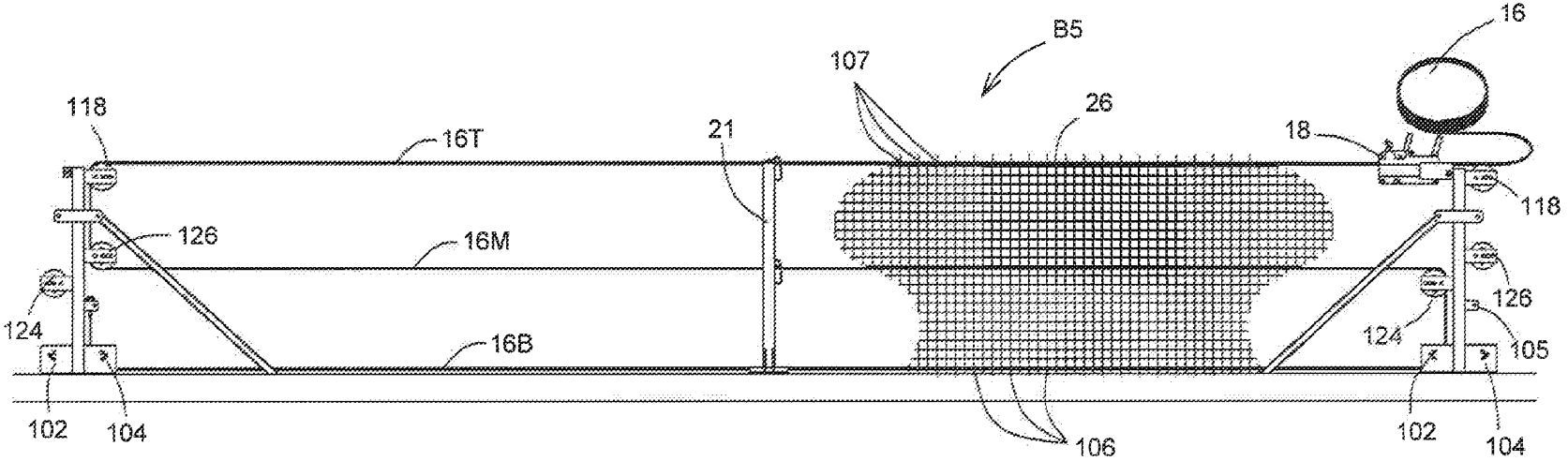
FIG. 13 front elevation view of a barrier wall of the kit of the present disclosure in accordance with another non-restrictive illustrative embodiment thereof.
Figure 14:
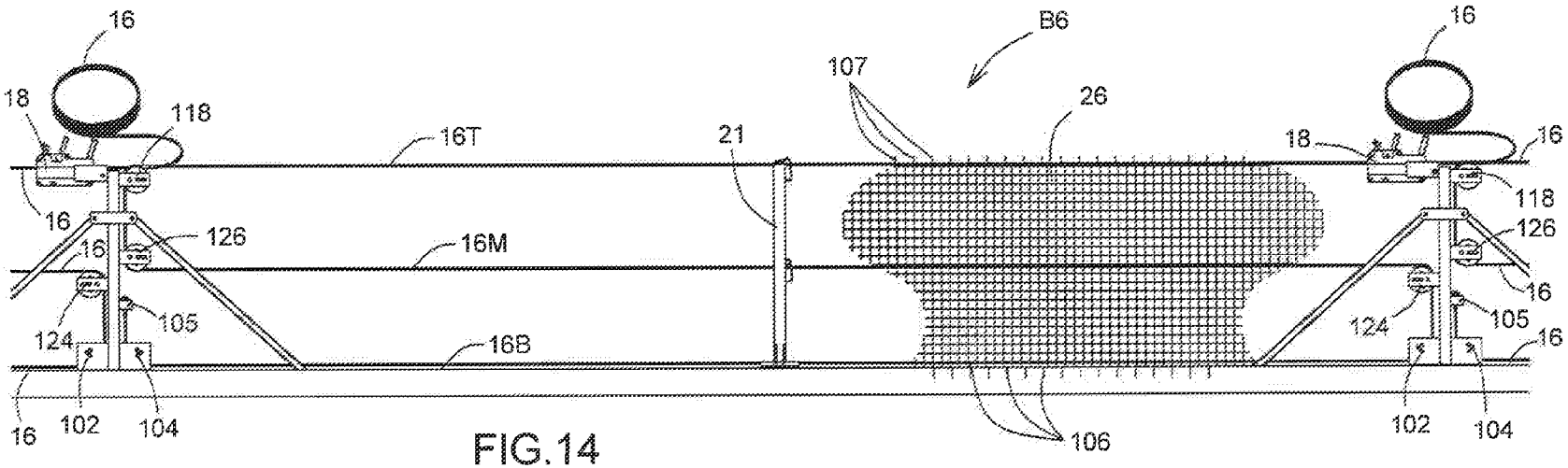
FIG. 14 front elevation view of a continuous barrier wall of the kit of the present disclosure in accordance with another non-restrictive illustrative embodiment thereof.

Of course, the kits of the present disclosure also provide a variety of inline barrier structures. In the illustrated examples, FIGS. 11 and 13 show inline barrier sections B3 and B5 and FIGS. 12 and 14 show continuous inline barrier structures B4 and B6.

Barrier B3 of FIG. 11 comprises a pair of inline vertical anchor posts 88A and 88B.

Figure 10:
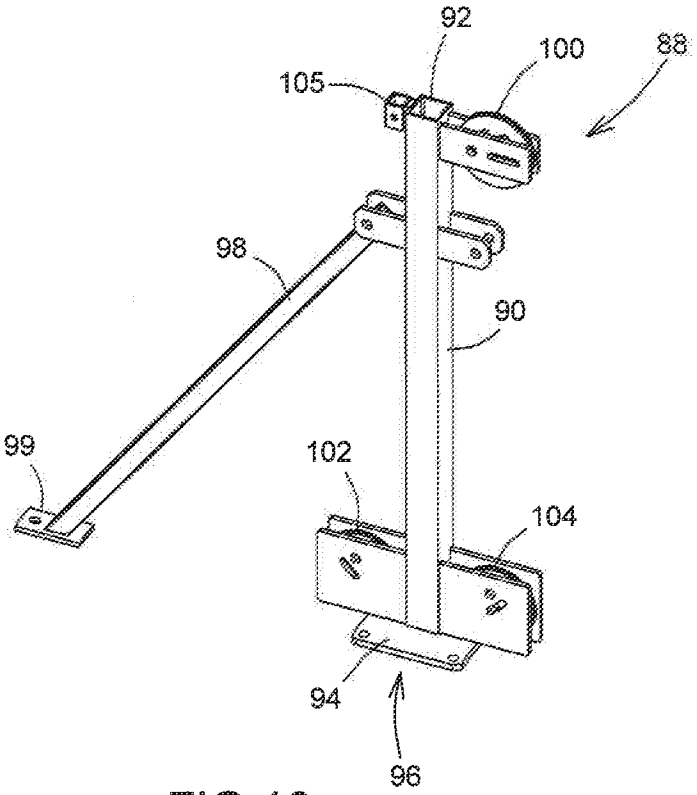
FIG. 10 is a perspective view of an inline anchor post of the kit of the present disclosure in accordance with a non-restrictive illustrative embodiment thereof.

FIG. 10 shows an inline vertical anchor post, generally denoted 88, comprising a main elongate body 90 defining top and bottom ends, 92 and 94 respectively. The bottom end 94 includes a platform 96 for being mounted to a surface S. A support leg 98 extends from the main body 90 and includes a foot member 99 to be mounted to a surface S, thereby providing support to the post 88 against wire pressure. Arcuate bodies, in the form of rollers, are mounted to the post 88. More particularly, a top roller 100 is mounted near the top end 92, whereas bottom rollers 102 and 104 are mounted near the bottom end 94. A support 106 is also mounted near the top end 92 for supporting a roller or a winch 18.

In FIG. 11, wire 16 from post member 88A runs from the winch 18 towards post member 88B where it engages the top roller 100, defining the wire top portion 16T then runs downwardly along the length of the main body 90 to engage the bottom roller 102 and to run back to the post 88A engaging the bottom roller 102, thereby defining the bottom wire portion 16B, and then run upwardly the main body 90 and be secured thereon. The material 26 is mounted via hooks 107 to the wire portions 16T and 16B. As previously described an inline guide post 20 is positioned between the posts 88A and 88B and engaged by the wire 16.

Barrier B3 is a barrier section, yet the kits provided herein also allow for building a continuous barrier such as B4 shown in FIG. 12. More specifically, post 88B includes a winch 18 mounted on the side opposite the top roller 100 for sending and receiving wire from a spaced apart inline vertical anchor post. Furthermore, post member 88A includes a top roller 100 opposite the winch 18 for receiving and sending wire from a spaced apart inline vertical anchor post.

Barrier B5 of FIG. 13 comprises a pair of inline vertical anchor posts 108A and 108B.

Figure 15:
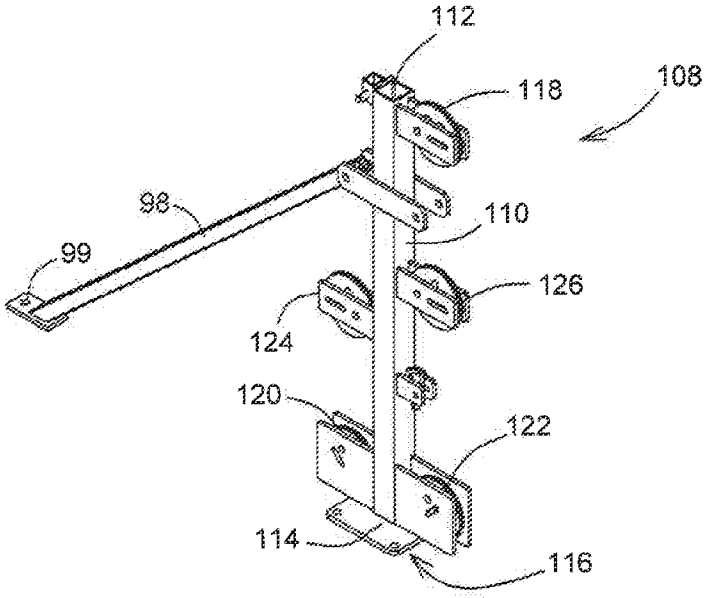
FIG. 15 is a perspective view of an inline anchor post of the kit of the present disclosure in accordance with another non-restrictive illustrative embodiment thereof.

FIG. 15 shows an inline vertical anchor post, generally denoted 108, comprising a main elongate body 110 defining top and bottom ends, 112 and 104 respectively. The bottom end 114 includes a platform 116 for being mounted to a surface S. A support leg 98 extends from the main body 110 and includes a foot member 99 to be mounted to a surface S, thereby providing support to the post 108 against wire pressure. Arcuate bodies, in the form of rollers, are mounted to the post 108. More particularly, a top roller 118 is mounted near the top end 112, whereas bottom rollers 120 and 1122 are mounted near the bottom end 114. A support 105 is also mounted near the top end 122 for supporting a roller or a winch 18. Intermediate rollers 124 and 126 are oppositely disposed on the main body 110 and interposed between the top roller 118 and the bottom rollers 120, 122. A support 128 is positioned on the main body 110 between bottom roller 122 and intermediate roller 126.

In FIG. 13, wire 16 from post member 108A runs from the winch 18 towards post member 108B where it engages the top roller 118 defining the wire top portion 16T then runs downwardly along the length of the main body 90 to engage the intermediate roller 126 and to run back to the post 108A engaging the intermediate roller 124, thereby defining the intermediate wire portion 16B. The wire then runs downwardly the main body 110 to engage the bottom roller 102 and runs back to the post 108B to engage bottom roller 104. The wire 16 then runs upwardly the main body 110 to be secured to the support 105. The material 26 is mounted via hooks 107 to the wire portions 16T and 16B. As previously described an inline guide post 21 is positioned between the posts 108A and 108B and engaged by the wire 16.

Barrier B4 is a barrier section, yet the kits provided herein also allow for building a continuous barrier such as B6 shown in FIG. 14. More specifically, post 108B includes a winch 18 mounted on the side opposite the top roller 118 for sending and receiving wire from a spaced apart inline vertical anchor post. Furthermore, post member 108A includes a top roller 118 opposite the winch 18 for receiving and sending wire from a spaced apart inline vertical anchor post.

In operation, the user can set up a plurality of anchor posts that are either inline posts or corner posts. The posts include acuate bodies for being engaged by a wire. The wire is run from on post to another and returned back to at least provide top and bottom wire sections. A number of arcuate bodies formed on the posts can provide for forming one or more intermediate wire sections between anchoring posts. Material is mounted to the wire sections to create barrier structures. A variety of inline or corner guide posts can be used for building wall sections or barrier corners. The kits allow for modifying the configuration of a barrier, making it longer or shorter and opening sections of it with relative ease. The arcuate bodies can be integral to the posts or be separate bodies that can be mounted thereon and positioned at various heights and angles thereby providing a variety of wall configurations having contiguous or discontinuous portions, as well as sections which are at relative angles from more than 0° to less than 360°. The distance between top and bottom wire sections can also be modified by moving or adjusting the height of the arcuate bodies thereby providing for differently configured barrier material to be mounted thereon.

Figure 17:
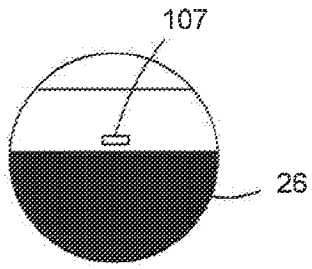
FIG. 17 is an enlarged view of portion A of FIG. 16.
Figure 16:
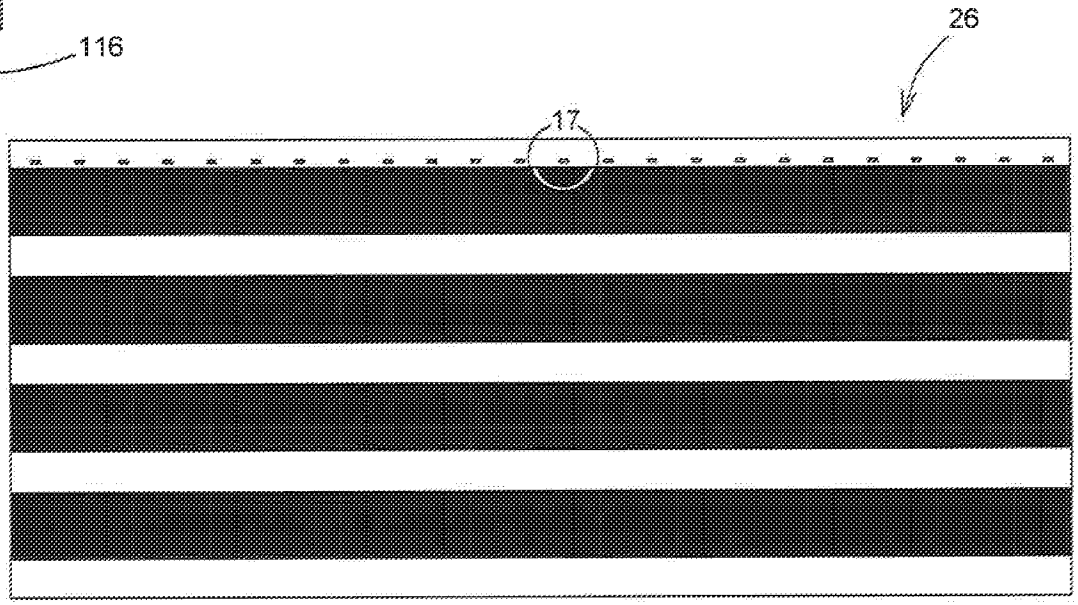
FIG. 16 is a front elevational view of the barrier material of the kit of the present disclosure in accordance with a non-restrictive illustrative embodiment thereof.

FIGS. 16 and 17 show a non-limiting example of a material 26 which can be netting or mesh made from a variety of organic and inorganic components. The top of the mesh includes holes 109 for receiving the hooks discussed abobe. The material may rigid or flexible and resilient. The skilled artisan will understand that a variety of suitable materials, compositions and configurations can be used for a variety of different purposes.

Figure 18B:
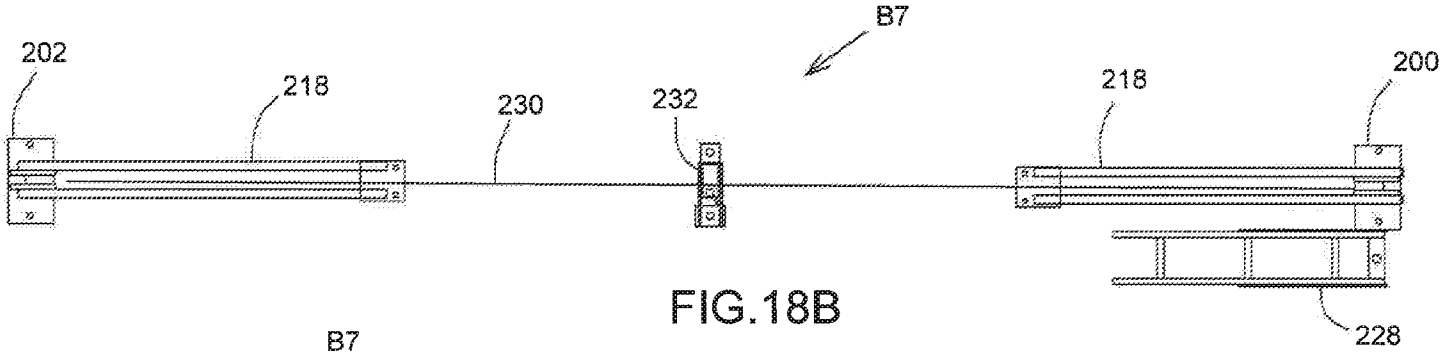
FIG. 18B is top plan view of the barrier of FIG. 18A.
Figure 18A:
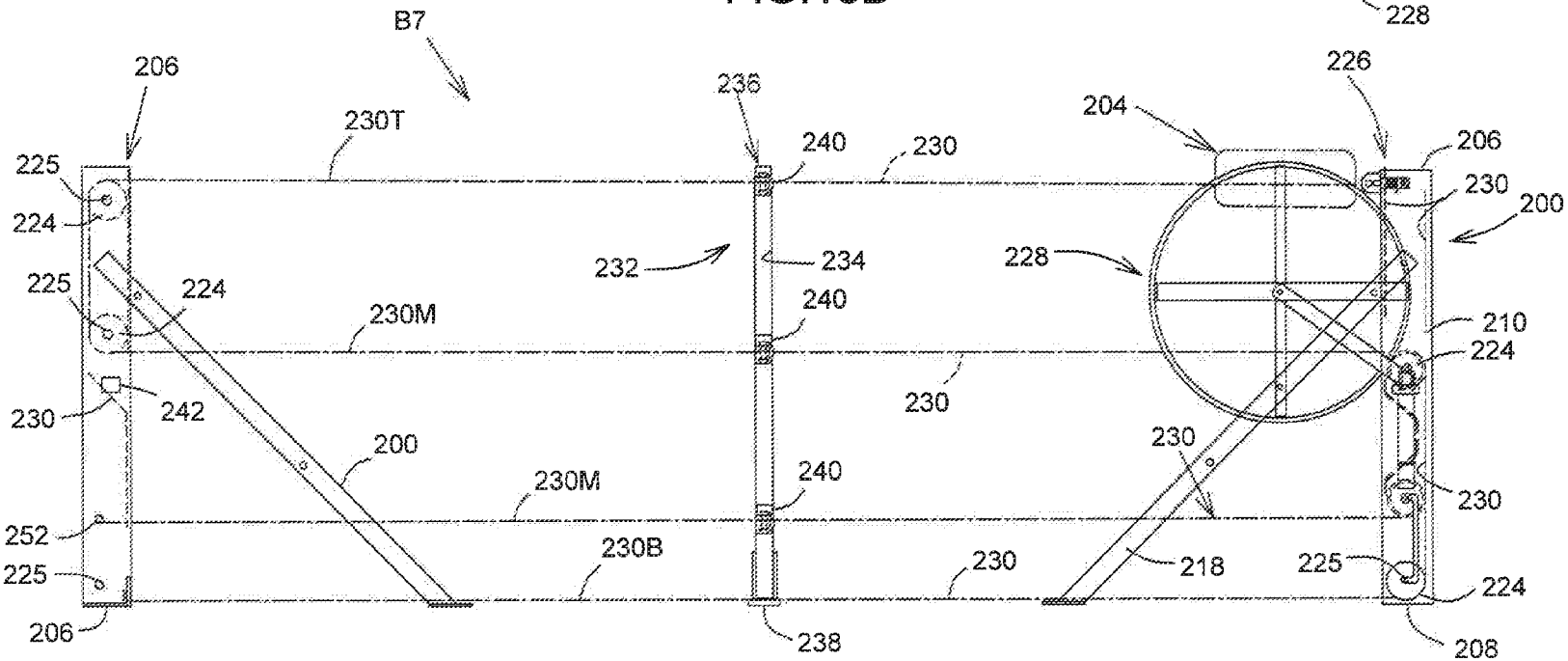
FIG. 18A is lateral side view of a barrier in accordance with non-restrictive illustrative embodiment of the present disclosure.

FIGS. 18A and 18B show a barrier B7 including an originating or winch post 200 and a terminal post 202.

The originating or winch post 200 and the terminal post 202 are similarly constructed with the exception that the winch post includes a winch or tensioning device 204.

More specifically and shown in FIGS. 18A, 19 and 20, the winch post 200 defines upper and bottom ends 206 and 208 and an elongate vertical body 210 including two spaced apart lateral panels 212A and 212B jointly mounted to a rear backing panel 214 and upstanding from respective laterally extending platforms 216A and 216B, respectively. A support leg 218 provides stability to the post 202. The support leg 218 includes spaced apart parallel longitudinal members 220A and 201B respectively mounted to panels 212A and 212B at one end thereof and being jointly mounted to a foot 222 which is mounted (e.g. bolted) to the floor surface. The leg 218 is diagonally positioned relative to the vertical post 200.

Arcuate members such as rollers 224 are interposed the spaced apart panels 212A and 212B and mounted thereto via roller shaft 225 as is known in the art.

The winch post 200 includes a bracket 226 near its top end 206 for mounting the winch 204 theteto. A cable reel 228 mounted to the post 202 includes the wire 230 which is fed into the winch 204 for being pulled therefrom as will be explained below.

As shown in FIGS. 18A and 21, the terminal post 202 is similarly constructed but does not include a winch 204 or a cable reel 228.

As shown in FIG. 18A, the barrier includes an inline guide post 232 having a vertically longitudinal body 234 defining top and bottom ends, 236 and 238. The body 234 includes brackets 240 along its length for supporting the wire 230 at various height levels as discussed above.

As shown in FIGS. 18A and 18B, the wire is looped back and forth between the two posts 200 and 202 defining a top portion 230T, an upper median portion 230UM a lower median portion 230LM and a bottom portion 230B that is on the floor. The rollers 224 are conveniently positioned along the length of the post bodies 210 to provide these wire portions at desired heights. The positions of the brackets 240 are correspondingly positioned at these desired heights.

The panels 212A and 212B of the post main body 210 provide a protective covering for both the wire 230 and the rollers 224. Internal deflectors 242 can be positioned within the space provided by the panels 212A, 212B and the backing 214 so as to guide the wire along various desired trajectories within the space provided by the body 210.

Figure 22:
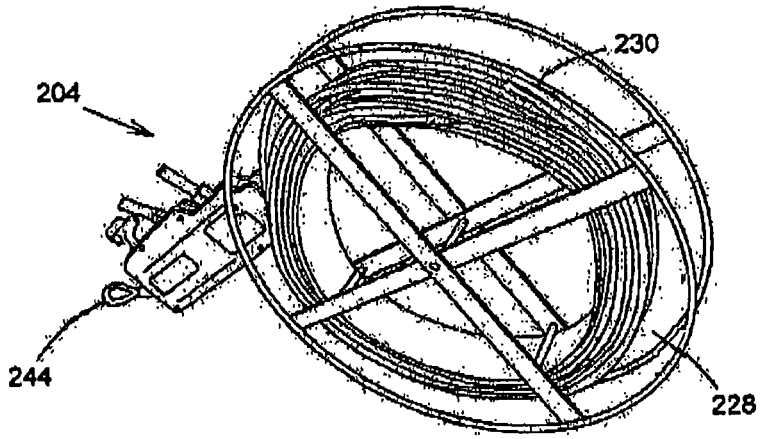
FIG. 22 is a perspective view of the tensioning device of the barrier of 18A and 18B in accordance with non-restrictive illustrative embodiment of the present disclosure.

FIG. 22 shows the winch 204 including the cable reel 228 with the wire 230. The free end of the wire 230 includes a loop 244.

Figure 23:
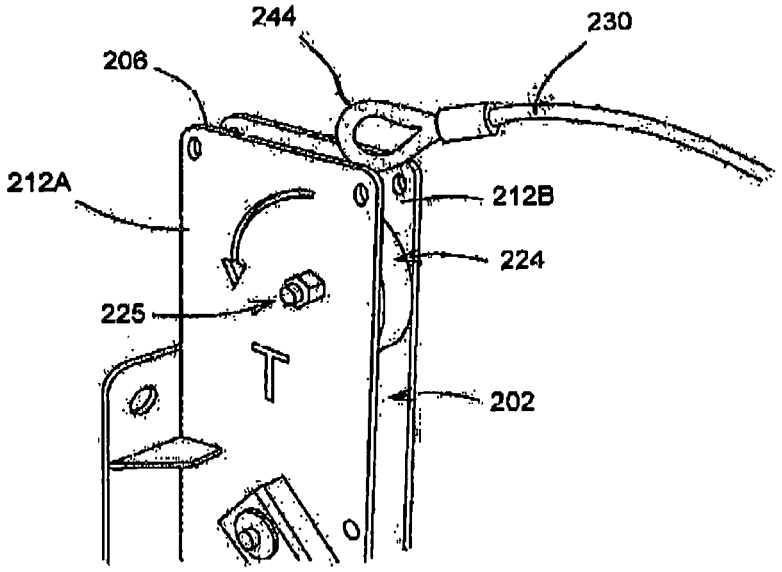
FIG. 23 is a top perspective view of the terminal end post of FIG. 21.

As shown in FIG. 23, when the wire 230 is pulled from the winch post 200 towards the terminal post 202, it is inserted from the open top end 206 defined between the space apart pales 212A and 212B about the roller 224 (near the top end 206) which is mounted to shaft 225.

Figure 24:
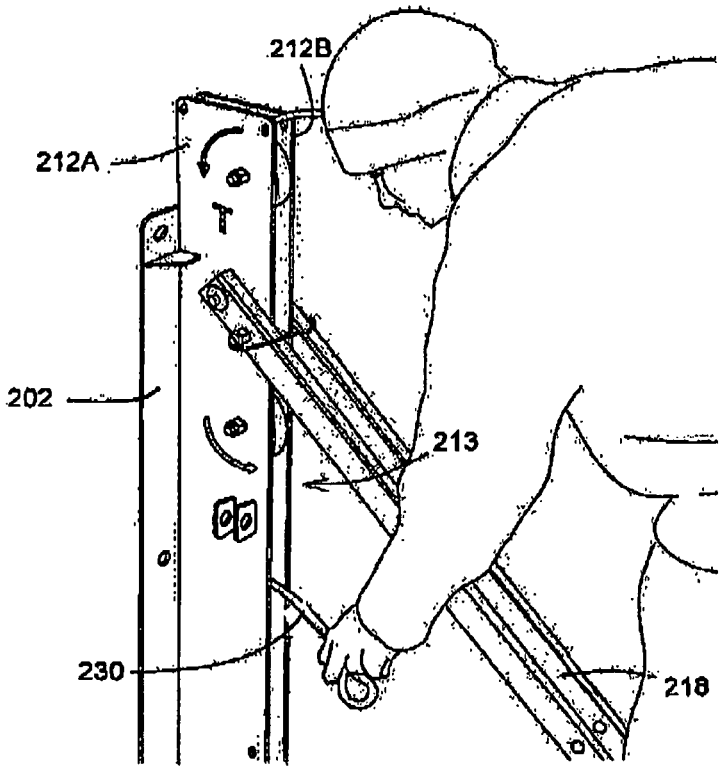
FIG. 24 is a lateral perspective view of a portion of the winch end post of FIGS. 19 and 20.
Figure 25:
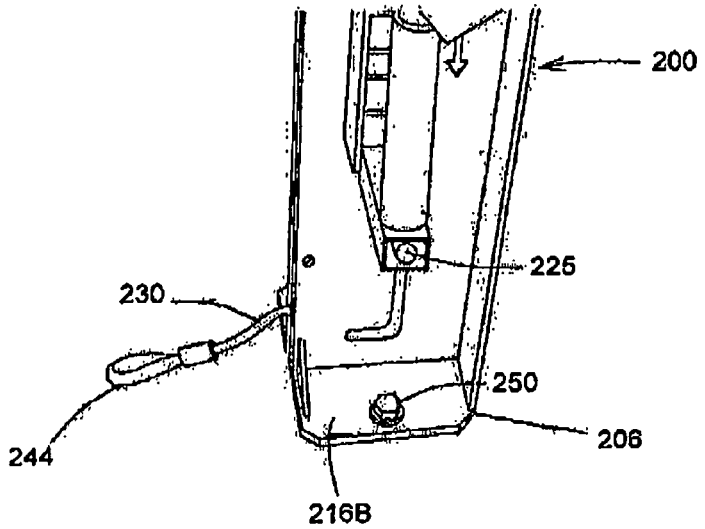
FIG. 25 is a perspective lateral view of a portion of the winch end post of FIGS. 19 and 20.

In FIG. 24, the wire is pulled downwardly into the body 210 and out of the front opening 213 defined by the spaced apart panel 212A and 212B to be pulled away from the terminal post 202 (via the space 221 of the spaced apart longitudinal members 220A and 220B of the leg 218 of post 202) and towards, as shown in FIG. 25, the winch post 200 (via the space 221 of the spaced apart longitudinal members 220A and 220B of the leg 218 of post 200) and into the body 210 of post 210 to be pulled downwardly therein about its internal rollers 224.

Figure 26:
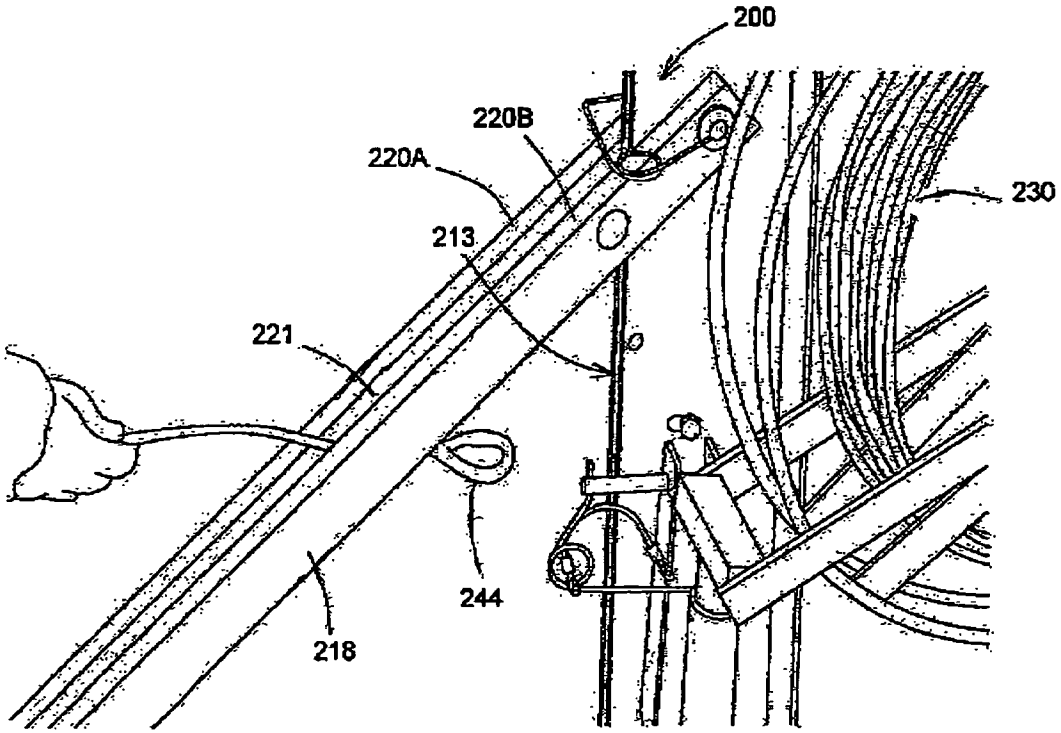
FIG. 26 is perspective lateral view of a bottom portion of the winch end post of FIGS. 19 and 20.

FIG. 26 shows the wire 230 being pulled back from the winch post 200 near its bottom end 206 about the roller 224 (not shown, but mounted on shaft 225 shown) to be positioned along the floor. As shown in FIG. 26, the platform portions (only 216B is shown) are bolted to the ground via bolts 250.

Figure 27:
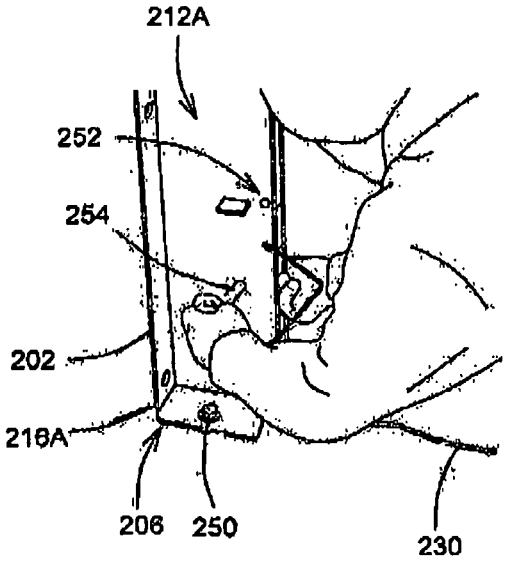
FIG. 27 is perspective lateral view of a bottom portion of the of the terminal end post of FIG. 21.

FIG. 27 shows the wire 230 having been pulled along the floor back towards the terminal post 202 to be secured thereto. The terminal post 202 includes holes 252 at its side panels 212A and 212B for inserting a fastener 254 thereto. The wire is 230 upwardly from the bottom end 206 within the body 210 about the bottom roller 224 to reach the height of the holes 252 so as to receive fastener 252 through its free end loop 244.

Figure 28:
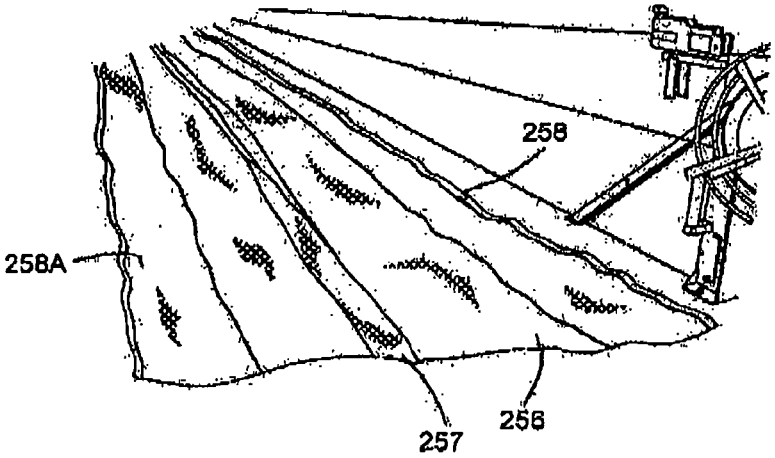
FIG. 28 is a perspective view of the mesh material for the barrier of FIGS. 18A and 18B.
Figure 29:
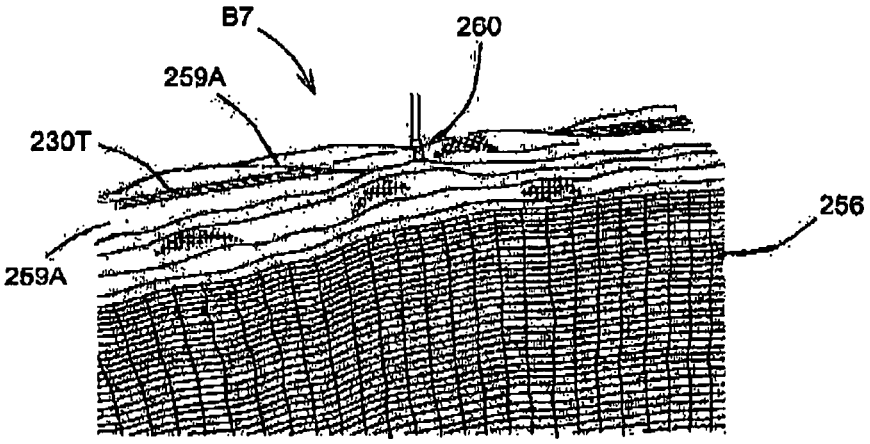
FIG. 29 is perspective lateral view of a top portion of the barrier of FIGS. 18A and 18B with the mesh material of FIG. 28 mounted thereto.

Once the wire 230 is secured to the posts 200 and 220, a mesh material 256 shown in FIGS. 28 and 29 is placed on the floor next to the wire and post structure described above and slipped under the bottom or floor wire portion 230B. The middle section 257 of the material 256 is positioned directly under the wire portion 230B and defines two half sheets 258A and 258B at each side thereof. The half sheets 258A and 258B are folded so as to sandwich therebetween the wire portions that run between the two posts 200 and 202. As shown in FIG. 29, the free ends 259A and 259B of half sheets 258A and 258B, respectively, are brought together about the top wire portion 230T and clipped together via a clip 260. Of course, the material 256 can be placed on the top wire portion 230T so as to cover the extending wire and have its free ends 259A and 258B clipped together with the bottom wire oprtion 230B.

The inline posts 232 are then added to complete the barrier B7.

Figure 32:
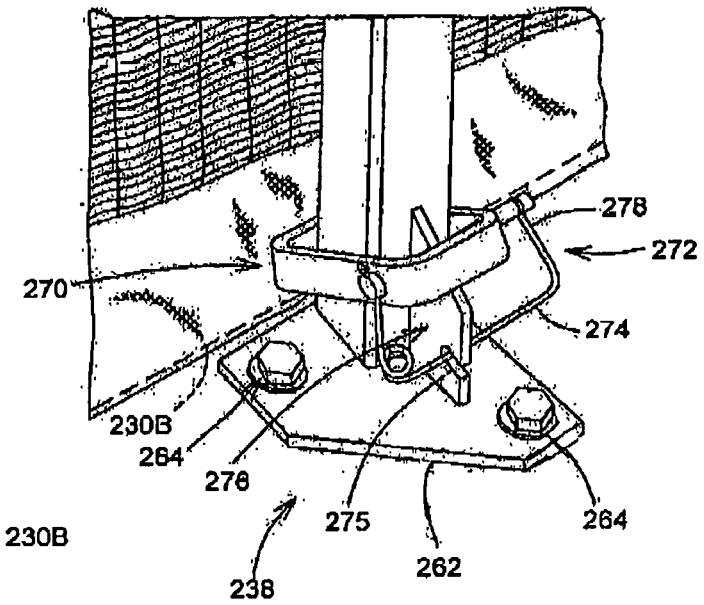
FIG. 32 is perspective rear and right side view of a bottom portion of the inline post of the barrier of FIGS. 18A and 18B with the mesh material of FIG. 28 mounted thereto.

As shown in FIG. 32, the bottom end 238 of the inline post 232 includes a platform 262 which fastened to the floor via fasteners 264.

Figure 30:
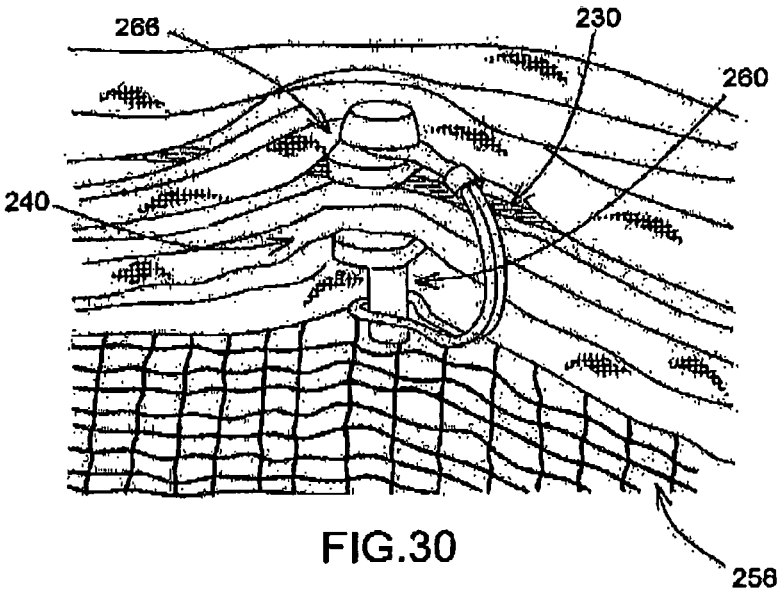
FIG. 30 is a closer lateral view of the barrier of FIGS. 18A and 18B with the mesh material of FIG. 28 mounted thereto.

As shown in FIG. 30, the brackets 240 mounted on the post 232 comprise a clamp 266 with a threaded set screw 268 for clamping the material 256 along with the wire 230.

Figure 31:
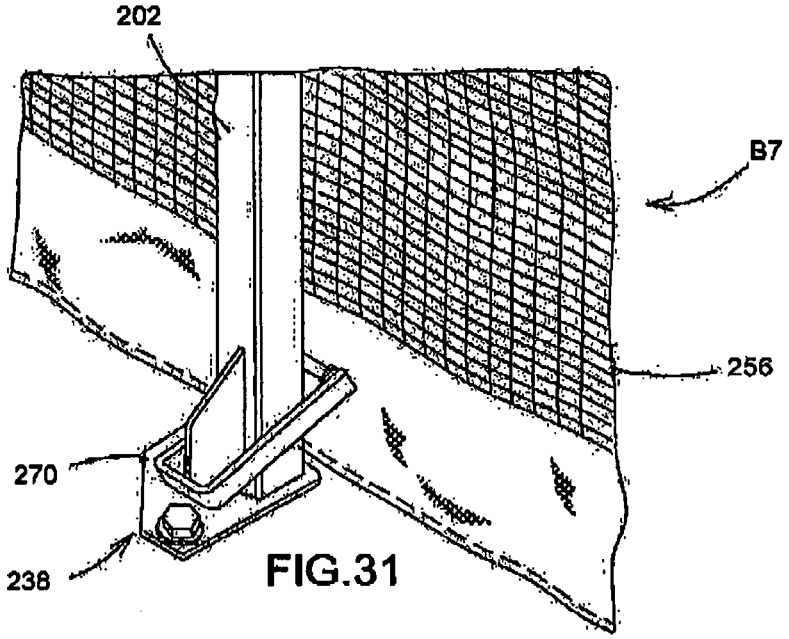
FIG. 31 is a perspective rear and left side view of a portion of the inline post of the barrier of FIGS. 18A and 18B with the mesh material of FIG. 28 mounted thereto.

Turning to FIGS. 31 and 32, the bottom wire portion 230B with the material is clamped down by a bottom clamp 270 pivotally mounted to the post 232 near the bottom end and having a rear lever 272 that moves it from the open (unclamping position, shown in FIG. 31) to the closed (or clamping position, shown in FIG. 32). The lever 272 includes a locking horizontal stem 274 that is positioned in an notch 275 formed in small plank 276 upstanding from the platform, thereby locking the lateral sides 278 of the lever 272 as shown in the Figures.

The skilled artisan can easily contemplate a variety of clamping structures for clamping the material 256 onto the wire 230 when interposed between the end posts 200 and 202

The distance between the posts 200 and 202 can be adjusted by feeding out more wire 230 from the reel 228 or recoiling the wire 230 back into the reel 228. Of course, at least one of the two posts 200 and 202 is moved further away from the other post.

The user can build corners by setting up another winch post 200 next to one of the two end posts of the barrier B7 and build another wall.

In order to disassemble the barrier B7, the material 256 is unclamped and unclipped and taken off the barrier B7. The loop 244 is unfastened and the wire 230 is rolled back on the reel 228 by the winch. The posts are then removed from the ground.

The foregoing provides a barrier which is easy and quick to assemble and disassemble as well as to modify in both length and configuration.

It should be noted that the various components and features of the embodiments described above, whether illustrated or not, can be combined in a variety of ways so as to provide still other embodiments within the scope of claims. As such, it is to be understood that the disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been described hereinabove by way of embodiments thereof, it can be modified, without departing from the spirit, scope and nature of the invention as defined herein and in the appended claims.

What is claimed is:

1. A kit for a temporary barrier comprising:

at least two vertical post members defining respective top and bottom ends thereof for being positioned on an underlying surface in a spaced apart relationship;

a contiguous wire for running and looped between the two vertical post members at least towards their respective top ends and at least towards their respective bottom ends thereby providing a top wire portion, a median wire portion and a bottom wire portion extending between the two vertical post members, the median wire portion being interposed between the top and bottom wire portions;

the two vertical post members comprising:

respective spaced apart and lateral panels contiguously running along a back panel and having an open front face for receiving the wire therethrough and into the space defined by the lateral and back panels;

respective top, median and bottom rollers interposed between the lateral panels along their respective length for rollingly receiving the wire, the median roller being interposed between the top and bottom rollers, the top, median and bottom rollers being positioned inwardly from the open front face, the bottom roller providing for the bottom wire portion to be on the underlying surface; and a fastener mounted to the panels for fastening a free end of the wire within the space defined by the lateral and back panels;

at least one tensioning device for being mounted to one of the two vertical post members near one of the top or bottom ends thereof for providing tension to the wire; and a material for being mounted to and enveloping the top, median and bottom wire portions and extending therebetween and at least towards each of the two vertical post members thereby forming a barrier, the material comprising a pair of sheets having a common edge and respective free ends for being folded together so as to sandwich the wire portions therebetween, wherein the free ends of the sheets are provided to be clipped together with at least one of the top, median or bottom wire portions.

2. A kit according to claim 1, wherein the wire is mounted on a reel for being fed between the vertical post members via the tensioning device, wherein the reel is provided to be mounted on one of the two spaced apart vertical post members.

3. A kit according to claim 1, wherein at least one of the two vertical post members comprises at least one support leg for extending therefrom to the underlying surface.

4. A kit according to claim 1, further comprising at least one additional vertical post member for being positioned between two vertical post members and comprising guide portions for respectively guiding the top and bottom wire portions.

5. A kit according to claim 4, wherein at least one guide portion comprises a clamp for clamping the wire.

6. A kit according to claim 5, further comprising a material for being mounted to the top and bottom wire portions and extending therebetween and at least towards each of the two vertical post members thereby forming the barrier, wherein the clamp clamps the wire with the material.

7. A kit according to claim 1, further comprising a leg for extending from the at least one vertical post member in the direction of the other vertical post member and being mounted to the underlying surface, the leg comprising a pair of spaced apart longitudinal members, each of the longitudinal members extending from a respective one of the spaced apart lateral panels and defining a space therebetween for allowing passage of the wire.

8. A kit according to claim 1, further comprising an additional vertical post member and an additional wire for running between one of the two vertical post members and the additional vertical post member.

9. A temporary barrier comprising:

at least two vertical post members defining respective top and bottom ends thereof for being positioned on an underlying surface in a spaced apart relationship;

a contiguous wire running and looped between the two vertical post members at least towards their respective top ends and at least towards their respective bottom ends thereby providing a to wire portion, a median wire portion and a bottom wire portion extending between the two vertical post members, the median wire portion being interposed between the top and bottom wire portions;

the two vertical post members comprising:

respective spaced apart and lateral panels contiguously running along a back panel and having an open front face for receiving the wire therethrough and into the space defined by the lateral and back panels;

respective top, median and bottom rollers interposed between the lateral panels along their respective length for rollingly receiving the wire, the median roller being interposed between the top and bottom rollers, the top, median and bottom rollers being positioned inwardly from the open front face, the bottom roller providing for the bottom wire portion to be on the underlying surface; and a fastener mounted to the panels for fastening a free end of the wire within the space defined by the lateral and back panels;

at least one tensioning device mounted to one of the two vertical post members near one of the top or bottom ends thereof for providing tension to the wire; and a material mounted to and enveloping the top, median and bottom wire portions and extending therebetween and at least towards each of the two vertical post members thereby forming a barrier, the material comprising a pair of sheets having a common edge and respective free ends for being folded together so as to sandwich the wire portions therebetween, wherein the free ends of the sheets are provided to be clipped together with at least one of the top, median or bottom wire portions.

* * * * *